US007364416B2

(12) United States Patent
Liang et al.

(10) Patent No.: US 7,364,416 B2
(45) Date of Patent: Apr. 29, 2008

(54) SCROLL TYPE COMPRESSOR WITH AN ENHANCED SEALING ARRANGEMENT

(75) Inventors: Kun-Yi Liang, Hsinchu (TW); Shu-Er Huang, Hsinchu (TW); Chun-Chung Yang, Hsinchu (TW); Hung-Chi Chen, Hsinchu (TW); Yu-Choung Chang, Hsinchu (TW); Bo-Chin Wang, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 11/494,454

(22) Filed: Jul. 28, 2006

(65) Prior Publication Data

US 2007/0134117 A1 Jun. 14, 2007

(30) Foreign Application Priority Data

Dec. 9, 2005 (TW) ..... 94143489 A
Jul. 5, 2006 (TW) ..... 95124426 A

(51) Int. Cl.
*F04C 18/02* (2006.01)
*F04C 2/00* (2006.01)

(52) U.S. Cl. ..... 418/55.5; 418/55.4; 418/57; 418/104; 417/310; 417/410.5

(58) Field of Classification Search ..... 418/55.1–55.6, 418/57, 180, 104, 107; 417/310, 410.5
See application file for complete search history.

(56) References Cited

U.S. PATENT DOCUMENTS 5,540,572 A * 7/1996 Park et al. ..... 418/55.5
6,059,549 A * 5/2000 Tarng et al. ..... 418/55.4
6,267,565 B1 * 7/2001 Seibel et al. ..... 417/292
6,913,448 B2 * 7/2005 Liang et al. ..... 418/55.5
7,207,787 B2 * 4/2007 Liang et al. ..... 418/55.1
2004/0126246 A1 * 7/2004 Liang et al. ..... 417/310

FOREIGN PATENT DOCUMENTS

JP 04121473 A * 4/1992
JP 05141201 A * 6/1993

* cited by examiner

*Primary Examiner*—Theresa Trieu
(74) *Attorney, Agent, or Firm*—Birch, Stewart, Kolasch & Birch, LLP

(57) ABSTRACT

A scroll type compressor with an enhanced sealing arrangement includes two sealing rings, mounted one between a first part of a gliding block and a first chamber of a fixed scroll and another one between a second part of the gliding block and a second chamber of the fixed scroll, respectively. The sealing ring has a U-shape cross section characterized in having a center depth smaller than half of a total height of the cross section. By providing such sealing rings, damage in mounting the sealing rings can be reduced to a minimum, possible leakage from the damage can be avoided, the assembly process in producing the compressor can be improved, and the compressor can be successfully merchandized.

8 Claims, 6 Drawing Sheets

SCROLL TYPE COMPRESSOR WITH AN ENHANCED SEALING ARRANGEMENT

BACKGROUND OF THE INVENTION (1) Field of the Invention

The invention relates to a sealing arrangement particularly applied to the scroll type compressor to adjustably avoid leakage in operation.

(2) Description of the Prior Art

In the art, while in cranking up a compressor, a rapid pressure boost is required to prevent the working fluid from possible stroking back. Also, the pressure shall be controlled in a reign so that the accumulated pressure won't be too high to damage the scrolls or the compression elements of the compressor, especially to those with a high compression ratio.

In U.S. Pat. No. 6,059,549, an improved high-low pressure chamber sealing arrangement for a volute compressor is disclosed, in which a single air chamber is formed by coupling a gliding block and scrolls. As the compressor is actuated, the gliding block can be pushed upwardly by the pressure variation in the air chamber and the spring force to support the partition block, such that the fluid in the high-pressure chamber can be inhibited to leak to the low-pressure chamber so as to quickly build up the pressure. However, a clear drawback of such an arrangement is that the force to lift the gliding block is close to zero at time of cranking up the compressor or at times when the compression ratio is too low. Under such situations, the gliding block is quite possible unable to overcome the friction and the weight itself to motion upwardly, and thus leakage or failure of building up the pressure may be expected. To resolve the foregoing problem, additional spring force is required to push the gliding block. On the other hand, when the compression ratio is too high, the resultant force from the gliding block and the spring element may make the gliding block unable to motion downwardly so as to relieve part of the load, and thus the reliability of the compressor is definitely degraded.

In US Pat. Pub. No. 2004/0126246, the difficulty in assembling the combination of the gliding block and the O ring into the receiving chamber makes impossible the mass production of the compressor. Also, in assembling the combination, the O ring is vulnerable to be cut by the chamber and thus may be damaged to induce further leakage which will definitely affect the service life and the reliability of the compressor.

SUMMARY OF THE INVENTION

Accordingly, it is an object of the present invention to provide a scroll type compressor with an enhanced sealing arrangement which can avoid leakage, make easy the assembly process in production, and merchandise the compressor.

In the present invention, the scroll type compressor with an enhanced sealing arrangement comprises a housing, a bracket body, a partition block, a pair of scrolls, a gliding block, two sealing rings and a plurality of air chambers. The housing for forming an internal accommodation space to accommodate the bracket body further has an inlet and an outlet. The partition block located above the bracket body in the housing separates the accommodation space into a high-pressure chamber and a low-pressure chamber. The scroll pair located between the partition block and the bracket body includes a fixed scroll and a rotary scroll to mesh the fixed scroll. A circular receiving chamber located on top of the fixed scroll further including a first chamber and a second chamber, where the first chamber located above the second chamber is larger than the second chamber in diameter. The gliding block located at a center portion on top of the fixed scroll further includes a first part and a neighboring second part. The first part also located above the second part is larger than the second part in diameter. Upon such an arrangement, the first part of the gliding block can locate above the first chamber, while the second part locates above the second chamber. By matching the gliding block and the scroll pair, a plurality of air chambers can be formed between the fixed scroll and the rotary scroll. Also, by providing pressure variations in these air chamber, the gliding block can be forced to glide.

The aforesaid sealing rings having U-shape cross sections are installed respectively to peripheral walls of the first part and the second part and located respectively to the first chamber and the second chamber of the receiving chamber. The sealing rings also satisfy the following limitations:

$$h<H/2, \text{ and}$$

$$\theta_1,\theta_2<20°$$

in which h is the depth of the U-shape cross section, H is the height of the U-shape cross section, and $\theta_1$, $\theta_2$ are the sidewall inclination angles of the U-shape cross section.

By providing the foregoing design criteria to the sealing rings, the load-regulating apparatus (i.e. the scroll type compressor) can be protected from the leakage.

All these objects are achieved by the scroll type compressor with an enhanced sealing arrangement described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a scroll type compressor with an enhanced sealing arrangement. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
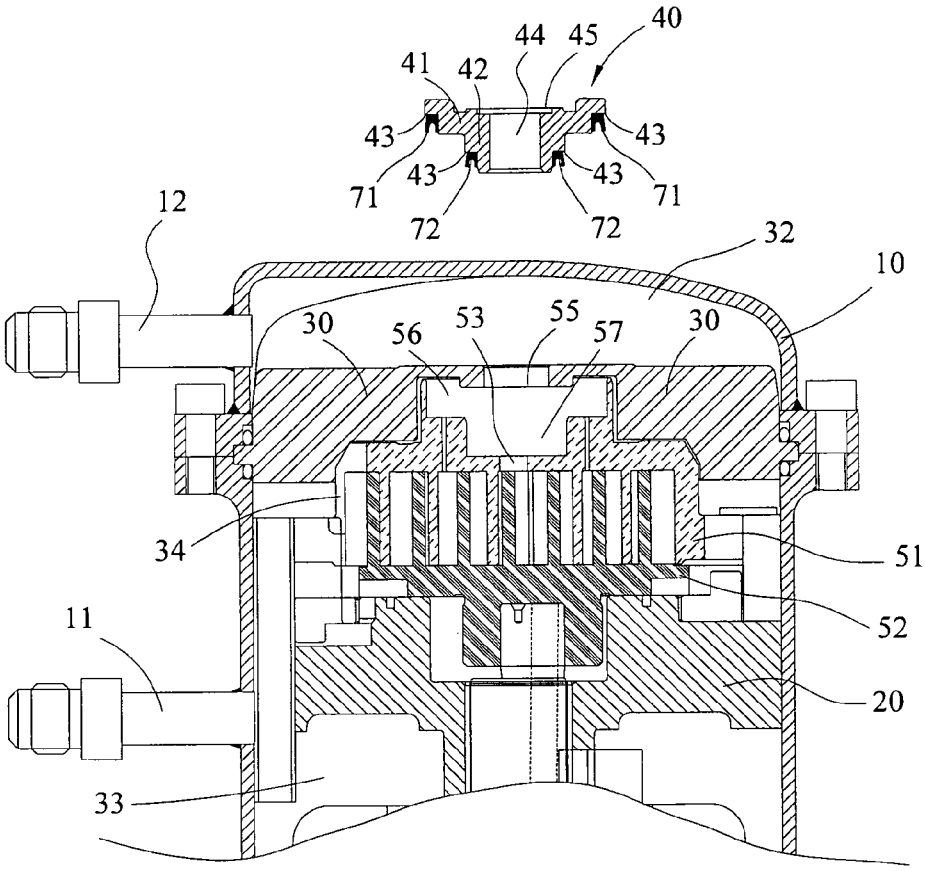
FIG. 1 is a vertically cross sectional view of a portion of a preferred embodiment of the scroll type compressor with an enhanced sealing arrangement in accordance with the present invention, in which the gliding block is separated from the compressor.

Referring now to FIG. 1, a top portion of a preferred embodiment of the scroll type compressor with an enhanced sealing arrangement in accordance with the present invention is vertically cross sectional shown. The scroll type compressor with an enhanced sealing arrangement comprises a housing 10, a bracket body 20, a partition block 30, a gliding block 40, a pair of scrolls 51,52, and a plurality of air chambers. The housing 10 further includes an inlet 11 and an outlet 12. The bracket body 20 is located inside the housing 10 and forms an internal accommodation space in between with the housing 10. The partition block 30 located above the bracket body 20 in the housing 10 separates the accommodation space into an upper high-pressure chamber 32 and a lower low-pressure chamber 33. The scroll pair located between the partition block 30 and the bracket body 20 includes a fixed scroll 51 and a rotary scroll 52 to mesh the fixed scroll 51. The gliding block 40 is located at a center portion on top of the fixed scroll 51 and forms a plurality of the air chambers in between with the scroll pair.

A circular receiving chamber 55 located on top of the fixed scroll 51 is included to mount the cylindrical gliding block 40. The receiving chamber 55 further includes a first chamber 56 and a second chamber 57, where the first chamber 56 located above the second chamber 57 is larger than the second chamber 57 in diameter. At the bottom portion of the gliding block 40, a first part 41 and a second part 42 are included, in which the first part 41 located above the second part 42 is larger than the second part 42 in diameter. In the state that the gliding block 40 is installed into the receiving chamber 55, the first part 41 of the gliding block 40 can locate above the first chamber 56, and the second part 42 can locate above the second chamber 57. Upon such an arrangement, a first air chamber 61 is formed between the first part 41 of the gliding block 40 and the first chamber 56, and a second air chamber 62 is formed between the second part 42 of the gliding block 40 and the second chamber 57. Also, it is noted that the first chamber 56 and the second chamber 57 of the receiving chamber 55 are firmed in a unique piece, and the first part 41 and the second part 42 of the gliding block 40 are formed in a single piece.

Figure 2A:
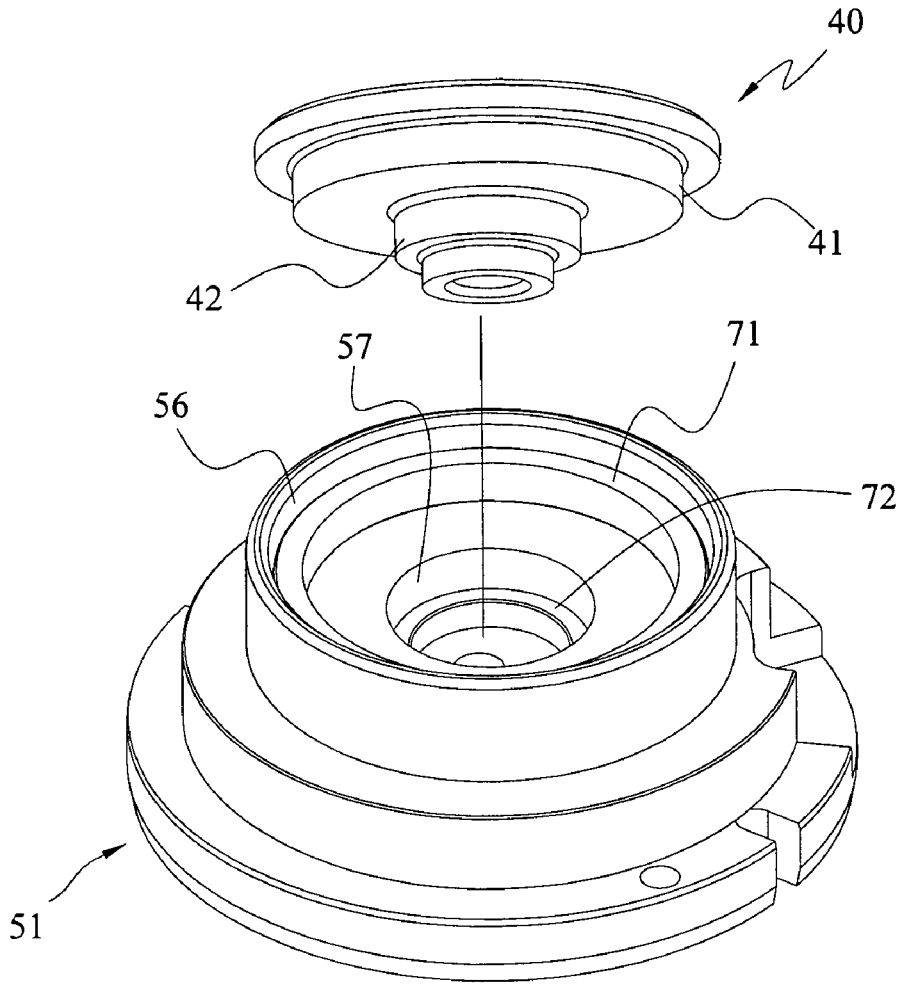
FIG. 2A is an exploded view of a preferred anti-leakage mechanism of FIG. 1.
Figure 2B:
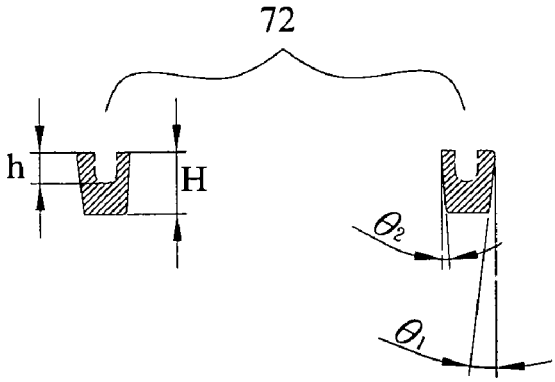
FIG. 2B is a cross sectional view of a preferred sealing ring of FIG. 2A.

As shown, peripheral sidewalls of the first part 41 and the second part 42 of the gliding block 40 includes respective grooves 43 for mounting the sealing rings 71 and 72, respectively. Referring also to FIG. 2A and FIG. 2B, the sealing ring 71 or 72 can be made of Teflon and has a U-shape cross section. The sealing rings 71 and 72 satisfy the following limitations:

$$h<H/2, \text{ and}$$

$$\theta_1,\theta_2<20°$$

in which h is the depth of the U-shape cross section, H is the height of the U-shape cross section, and $\theta_1$, $\theta_2$ are the sidewall inclination angles of the U-shape cross section.

By providing the foregoing design criteria to the sealing rings 71 and 72, the air leakage between the gliding block and the receiving chamber 55 can be substantially avoided. Also, air holes 44 at the center of the gliding block 40 can be included to communicate in space with the letting-out hole 53 of the fixed scroll 51.

Figure 3:
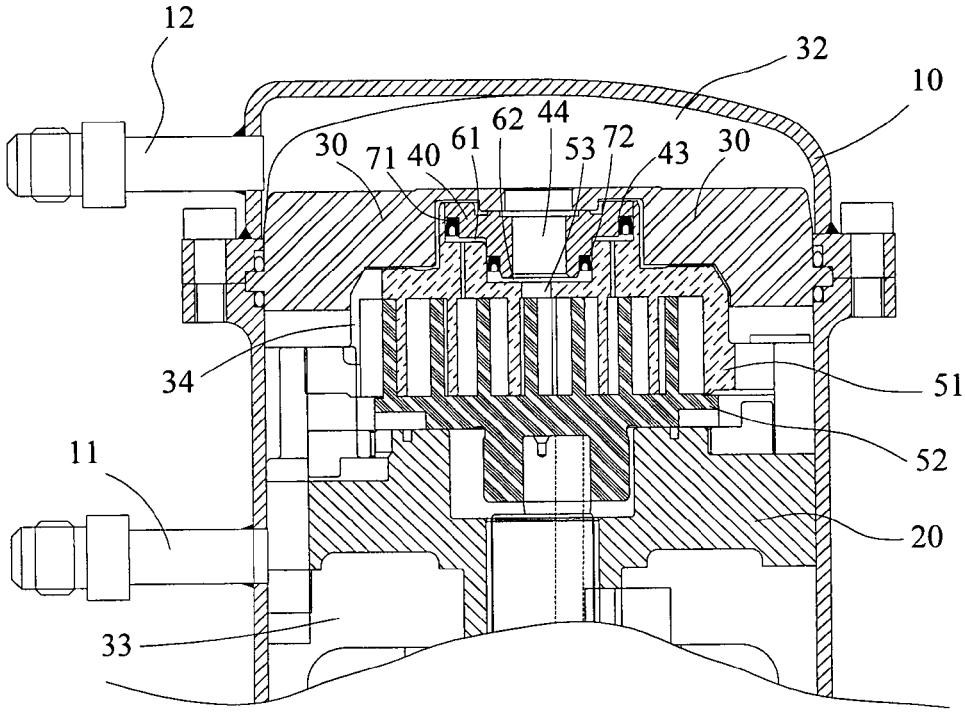
FIG. 3 is another state of FIG. 1 with the gliding block installed into the compressor.

Referring now to FIG. 3, it is noted that the inlet 11 of the housing 10 is used to introduce the work fluid into the compressor for air compression, and that the outlet 12 of the housing 10 is used to discharge the compressed high-pressure air. The fixed scroll 51 and the rotary scroll 52 are involute-shaped. At a center of the fixed scroll 51, a letting-out hole 53 is formed for throughput the compressed high-pressure work fluid into the high-pressure chamber 32.

Figure 4:
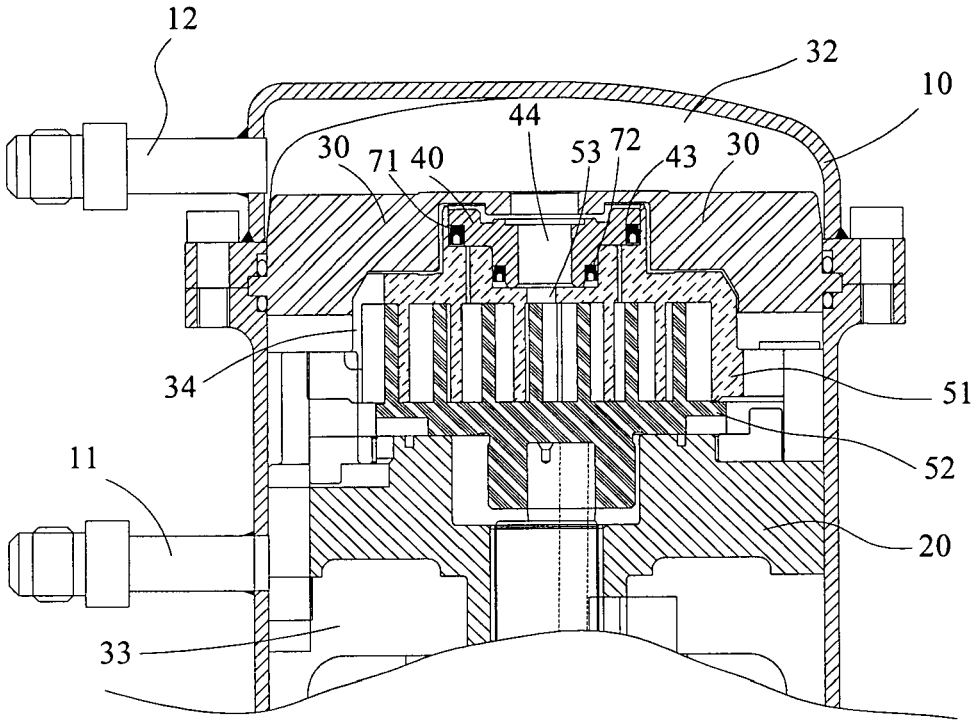
FIG. 4 shows a further state of FIG. 3.

In the case that the compressor is cranked to a state as shown in FIG. 4, the low-pressure fluid is sucked into the low-pressure chamber 33 through the inlet 11 of the housing 10. Then, the fluid is sent into the scroll pair through a sucking-in hole 34. Refer now to FIG. 4. By means of co-orbiting motions between the fixed scroll 51 and the rotary scroll 52, the first air chamber 61 in between is quickly filled with the fluid. At the current state, for the upward thrust applied to the gliding block 40 from the first air chamber 61 is greater than the downward thrust applied to the gliding block 40 from the second air chamber 62, the gliding block 40 is pushed upward to quick build a substantial high pressure in the compressor, as shown in FIG. 3. As soon as the compression ration of the compressor reaches a predetermined high value to have the pressure on the top surface 45 of the gliding block 40 greater the total thrust from the first chamber 61 and the second chamber 62, the gliding block 40 would be pushed downward by the resultant downward forcing as well as the weight of the gliding block 40. At this stage, the fluid in the high-pressure chamber 32 would be discharged to the low-pressure chamber 33 in order to relieve part of the load.

Figure 5:
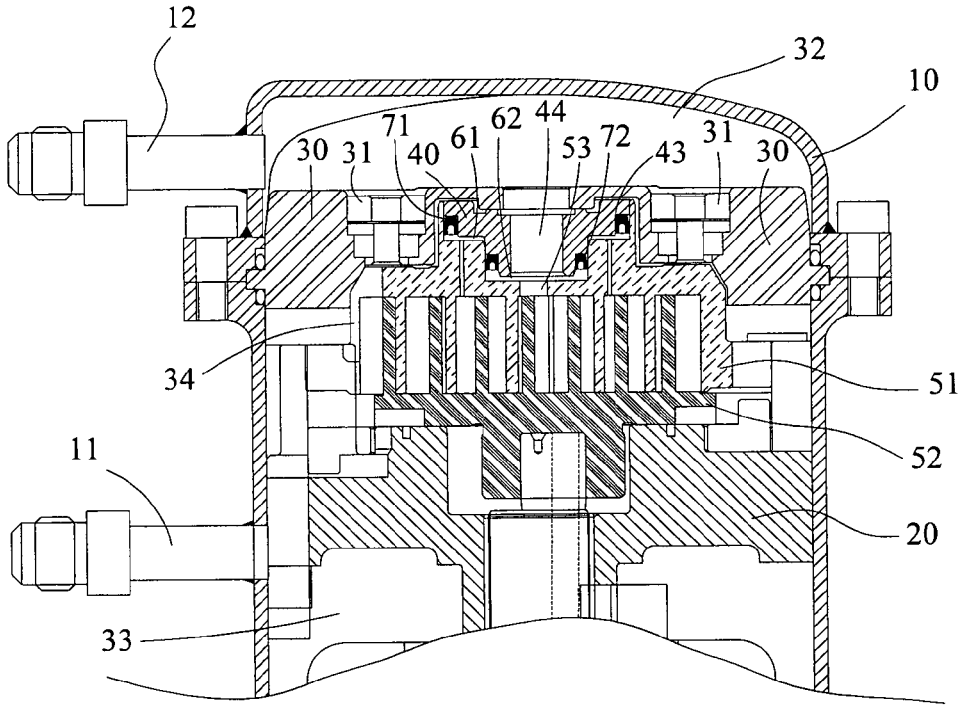
FIG. 5 is a vertically cross sectional view of a portion of another embodiment of the scroll type compressor with an enhanced sealing arrangement in accordance with the present invention.

Referring to FIG. 5, a vertically cross sectional view of a portion of another embodiment of the scroll type compressor with an enhanced sealing arrangement in accordance with the present invention is shown. In this embodiment, the partition block 30 has at least a back-pressure regulating ring 31. In operation of the compressor, the fluid with a medium to high pressure is led to the air chamber located behind the back-pressure regulating ring 31 so as to build a forcing for ensuring the tight contact in the scroll pair in the axial direction, and thus possible leakage of the compressed fluid in each working chamber can be avoided.

Figure 6:
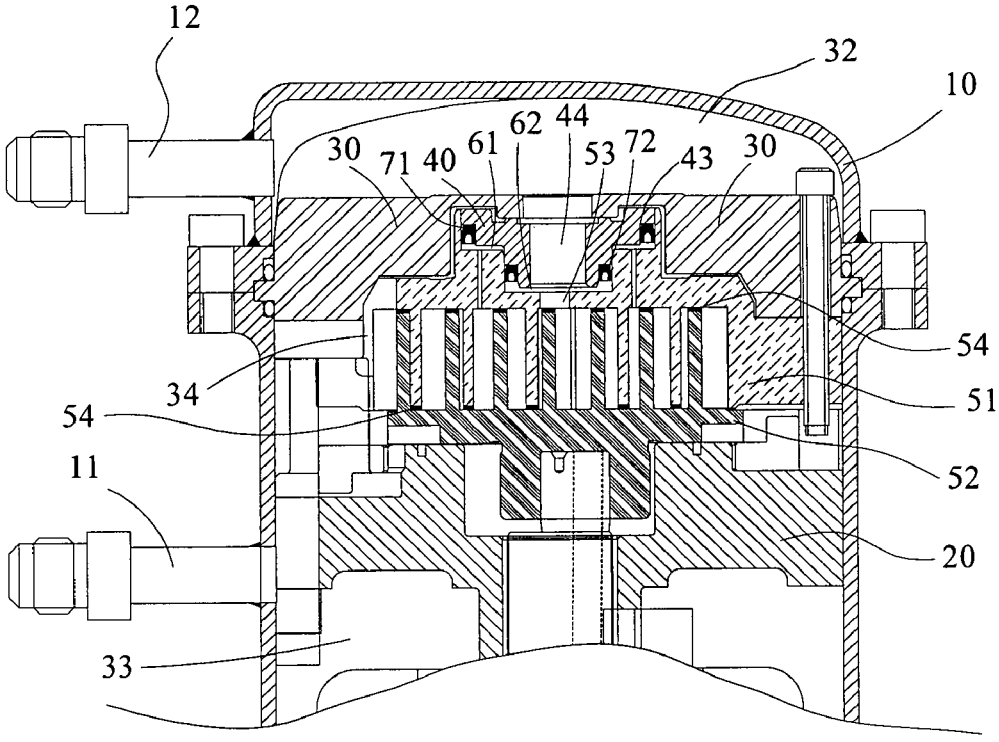
FIG. 6 is a vertically cross sectional view of a portion of a further embodiment of the scroll type compressor with an enhanced sealing arrangement in accordance with the present invention.

Referring to FIG. 6, a vertically cross sectional view of a portion of a further embodiment of the scroll type compressor with an enhanced sealing arrangement in accordance with the present invention is shown. In this embodiment, a pair of sealing elements 54 is introduced to seal the tip ends of the fixed scroll 51 and the rotary scroll 52. By providing the sealing elements 54, the co-orbiting motions in the scroll pair can be performed in a better airtight environment so that the effectiveness in compressing the fluid in the scroll pair can be enhanced.

While the present invention has been particularly shown and described with reference to a preferred embodiment, it will be understood by those skilled in the art that various changes in form and detail may be without departing from the spirit and scope of the present invention.

We claim:

1. A scroll type compressor with an enhanced sealing arrangement, comprising:

a housing, further having an inlet and an outlet;

a bracket body, located inside the housing, forming an internal accommodation space in between with the housing;

a partition block, located above the bracket body in the housing, integrating the bracket body to separate the accommodation space into a high-pressure chamber and a low-pressure chamber, further having a letting-out hole at a center thereof;

a scroll pair, located between the partition block and the bracket body, including a fixed scroll and a rotary scroll to mesh the fixed scroll, the fixed scroll having on top thereof a circular receiving chamber, the receiving chamber further including a first chamber and a second chamber that the first chamber located above the second chamber is larger than the second chamber in diameter;

a gliding block, located at a center portion on top of the fixed scroll, further including a first part and a second part that the first part located above the second part is larger than the second part in diameter, the second part located above the second chamber;

two sealing rings, installed respectively to peripheral walls of the first part and the second part and located respectively to the first chamber and the second chamber of the receiving chamber, having respective U-shape cross sections, the sealing rings satisfying the following limitations:

$h<H/2$, and $\theta 1, \theta 2<20°$ in which the h is a depth of the respective U-shape cross section, the H is a height of the respective U-shape cross section, and the θ1, θ2 are sidewall inclination angles of the respective U-shape cross section; and a plurality of air chambers, formed by matching the gliding block and the scroll pair;

wherein, by providing pressure variations in the air chambers, the gliding block is forced to glide accordingly.

2. The scroll type compressor with an enhanced sealing arrangement according to claim 1, wherein said partition block further includes a back-pressure regulating ring.

3. The scroll type compressor with an enhanced sealing arrangement according to claim 1, wherein a pair of sealing elements is introduced to seal respective tip ends of said fixed scroll and said rotary scroll.

4. The scroll type compressor with an enhanced sealing arrangement according to claim 1, wherein said gliding block has an air hole at a center thereof to communicate in space with said letting-out hole.

5. The scroll type compressor with an enhanced sealing arrangement according to claim 1, wherein said first chamber and said second chamber are integrated in a single piece.

6. The scroll type compressor with an enhanced sealing arrangement according to claim 1, wherein said first part and said second part are integrated in a single piece.

7. The scroll type compressor with an enhanced sealing arrangement according to claim 1, wherein said sealing ring is a circular ring with said U-shape cross section.

8. The scroll type compressor with an enhanced sealing arrangement according to claim 1, wherein said sealing ring is made of Teflon.

* * * * *